US008365468B2

(12) United States Patent
Weekes

(10) Patent No.: US 8,365,468 B2
(45) Date of Patent: Feb. 5, 2013

(54) METAL BAHAMA STYLE STORM SHUTTER

(75) Inventor: Greg Weekes, Boynton Beach, FL (US)

(73) Assignee: Eastern Metal Supply, Inc., West Palm Beach, FL (US)

( * ) Notice: Subject to any disclaimer, the term of this patent is extended or adjusted under 35 U.S.C. 154(b) by 349 days.

(21) Appl. No.: 12/320,987

(22) Filed: Feb. 10, 2009

(65) Prior Publication Data

US 2009/0293399 A1 Dec. 3, 2009

Related U.S. Application Data

(60) Provisional application No. 61/064,006, filed on Feb. 11, 2008.

(51) Int. Cl.
*E06B 7/08* (2006.01)

(52) U.S. Cl. ..... 49/92.1; 49/74.1; 49/403; 49/381; 49/394; 49/61; 49/62; 49/50; 52/473; 52/202

(58) Field of Classification Search ..... 49/74.1, 49/50, 403, 92.1, 73.1, 381, 394, 61–63, 49/67, 56, 345; 52/202, 203, 473
See application file for complete search history.

(56) References Cited

U.S. PATENT DOCUMENTS

| | | | | | |
|---|---|---|---|---|---|
| 2,136,012 | A | * | 11/1938 | Jones | 160/58.1 |
| 2,587,440 | A | * | 2/1952 | Burkhart | 52/706 |
| 3,077,643 | A | * | 2/1963 | Horner | 52/473 |
| 3,577,864 | A | * | 5/1971 | Sommerfeld | 52/473 |
| 3,691,687 | A | * | 9/1972 | Economou | 49/74.1 |
| 4,655,003 | A | * | 4/1987 | Henley, Sr. | 49/87.1 |
| 4,733,515 | A | * | 3/1988 | Schmidlin | 52/473 |
| 4,855,716 | A | * | 8/1989 | Jordal | 340/550 |
| 4,858,400 | A | * | 8/1989 | Foyt | 52/98 |
| 4,939,880 | A | * | 7/1990 | Wang | 52/473 |
| 5,060,442 | A | * | 10/1991 | Chubb | 52/473 |
| 5,255,486 | A | * | 10/1993 | Wang | 52/473 |
| 5,339,591 | A | * | 8/1994 | Underdahl | 52/473 |
| 5,342,187 | A | * | 8/1994 | Ohanesian | 425/70 |
| 5,347,756 | A | * | 9/1994 | Abbott et al. | 49/74.1 |
| 5,737,874 | A | * | 4/1998 | Sipos et al. | 49/67 |
| 5,907,929 | A | * | 6/1999 | Poma et al. | 52/78 |
| 6,219,985 | B1 | * | 4/2001 | Hsu | 52/473 |
| 6,536,174 | B2 | * | 3/2003 | Foster et al. | 52/473 |
| 6,543,188 | B1 | * | 4/2003 | Poma et al. | 52/78 |
| 6,877,285 | B2 | * | 4/2005 | Poma et al. | 52/202 |
| 6,886,294 | B1 | * | 5/2005 | Carey | 49/73.1 |
| 7,131,241 | B2 | * | 11/2006 | Blackwell et al. | 52/473 |
| 7,131,480 | B2 | * | 11/2006 | Briscoe et al. | 160/117 |
| 7,222,456 | B1 | * | 5/2007 | Carey | 49/73.1 |
| 7,363,748 | B2 | * | 4/2008 | Gabriele | 49/403 |
| 7,677,003 | B2 | * | 3/2010 | Baughn et al. | 52/473 |
| 2005/0204630 | A1 | * | 9/2005 | Nien | 49/74.1 |
| 2005/0210777 | A1 | * | 9/2005 | Baughn et al. | 52/202 |
| 2006/0162266 | A1 | * | 7/2006 | Hay | 52/202 |
| 2006/0168889 | A1 | * | 8/2006 | Logan et al. | 49/74.1 |
| 2007/0137108 | A1 | * | 6/2007 | Ohanesian | 49/74.1 |
| 2007/0157519 | A1 | * | 7/2007 | Nien et al. | 49/74.1 |

* cited by examiner

*Primary Examiner* — Katherine W Mitchell
*Assistant Examiner* — Marcus Menezes
(74) *Attorney, Agent, or Firm* — Connolly Bove Lodge & Hutz LLP

(57) ABSTRACT

A metal shutter with improved air and light transmission is provided. The shutter comprises a metal top, a metal bottom, and two metal sides, which can be collectively assembled into a frame. The frame can have a metal support column that can be affixed to the top and bottom. A number of metal slats can be affixed between the sides of the shutter, and can either pass through the center column or can be affixed to the center column. A hinge can be affixed to the top of the frame, and can also be affixed to a structure. The top, bottom, sides, support column, slats, hinge, and a lock all comprise the shutter. The hinge allows the shutter to rotate between a first, substantially vertical, position, and a second, non-vertical position. The lock holds the shutter to a structure when the shutter is in the first position.

14 Claims, 10 Drawing Sheets

METAL BAHAMA STYLE STORM SHUTTER

CROSS REFERENCE TO RELATED APPLICATIONS

The instant application claims priority to 61/064,006 filed Feb. 11, 2008, the disclosure of which is incorporated by reference herein in its entirety.

BACKGROUND OF THE INVENTION

1. Field of the Invention

The present invention relates to storm shutters for windows of buildings. It protects the interior of the building from damage from high winds and wind-borne objects. Since it will not be ripped free of the building, it also protects the exterior of the building from damage.

2. Background

Shutters are used for decoration, security, and weather protection. Recent powerful hurricanes in the southeastern United States have raised building protection as a serious issue. Shutters are often used in these and other regions to provide protection during hurricanes and other strong storms. Shutters provide light and air during a storm, while protecting the building and the occupants from airborne objects. Many coastal portions of the United States require that homes and businesses have metal storm shutters over windows to protect the interior of the buildings during extreme weather which is common to this part of the country.

There are various different types of metal shutters on the market. However, most do not allow in light or air when deployed, creating claustrophobic conditions inside the building. Others need to be put up and taken down for every storm, which is a tedious process.

The Bahama shutter is a common type of shutters which is permanently attached to a building by a hinge at the top of the window opening, and their design allows some light and air to enter the building even when closed. However, these shutters were usually made of wood, which does not satisfy most building code requirements and are not strong enough to withstand hurricane winds. The wood components cannot simply be replaced with stronger materials such as metal, as the design would be too heavy and unstable in that configuration.

SUMMARY OF THE INVENTION

It is an object of the present invention to provide a shutter that can withstand hurricane and tropical storm force winds that also lets in light and air.

According to one embodiment, the shutter comprises a metal top, a metal bottom, and two metal sides, which can be collectively assembled into a frame. The frame can have a metal support column that can be affixed to the top and bottom. A number of metal slats can be affixed between the sides of the shutter, and can either pass through the center column or can be affixed to the center column. A hinge can be affixed to the top of the frame, and can also be affixed to a structure. The top, bottom, sides, support column, slats, hinge, and a lock all comprise the shutter. The hinge allows the shutter to rotate between a first, substantially vertical, position, and a second, non-vertical position. The lock holds the shutter to a structure when the shutter is in the first position.

According to another embodiment, the slats are diagonal relative to a horizontal plane when the frame is in the first position.

According to another embodiment, the slats are substantially horizontal when the frame is in the second position.

According to another embodiment, the sides have a plurality of parallel, diagonal slots configured to receive the slats.

According to another embodiment, the hinge comprises a first partially cylindrical portion and a second partially cylindrical portion. The second partially cylindrical portion is configured so that it can be coaxially inserted into the first partially cylindrical portion.

According to another embodiment, the lock is either a bolt, a deadbolt, a padlock, a catch, a lever, or a latch.

According to another embodiment, the center support column is "I" shaped.

According to another embodiment, the slats are substantially hollow.

According to another embodiment, the slats have hollow partial cylinders on opposing sides of the slats.

According to another embodiment, screws are inserted into at least some of the hollow partial cylinders of the slats through the sides of the frame.

According to another embodiment, the top and bottom of the frame comprise hollow partial cylinders.

According to another embodiment, screws are inserted into hollow partial cylinders of the top and bottom of the frame through the sides of the frame.

DETAILED DESCRIPTION OF EXEMPLARY EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
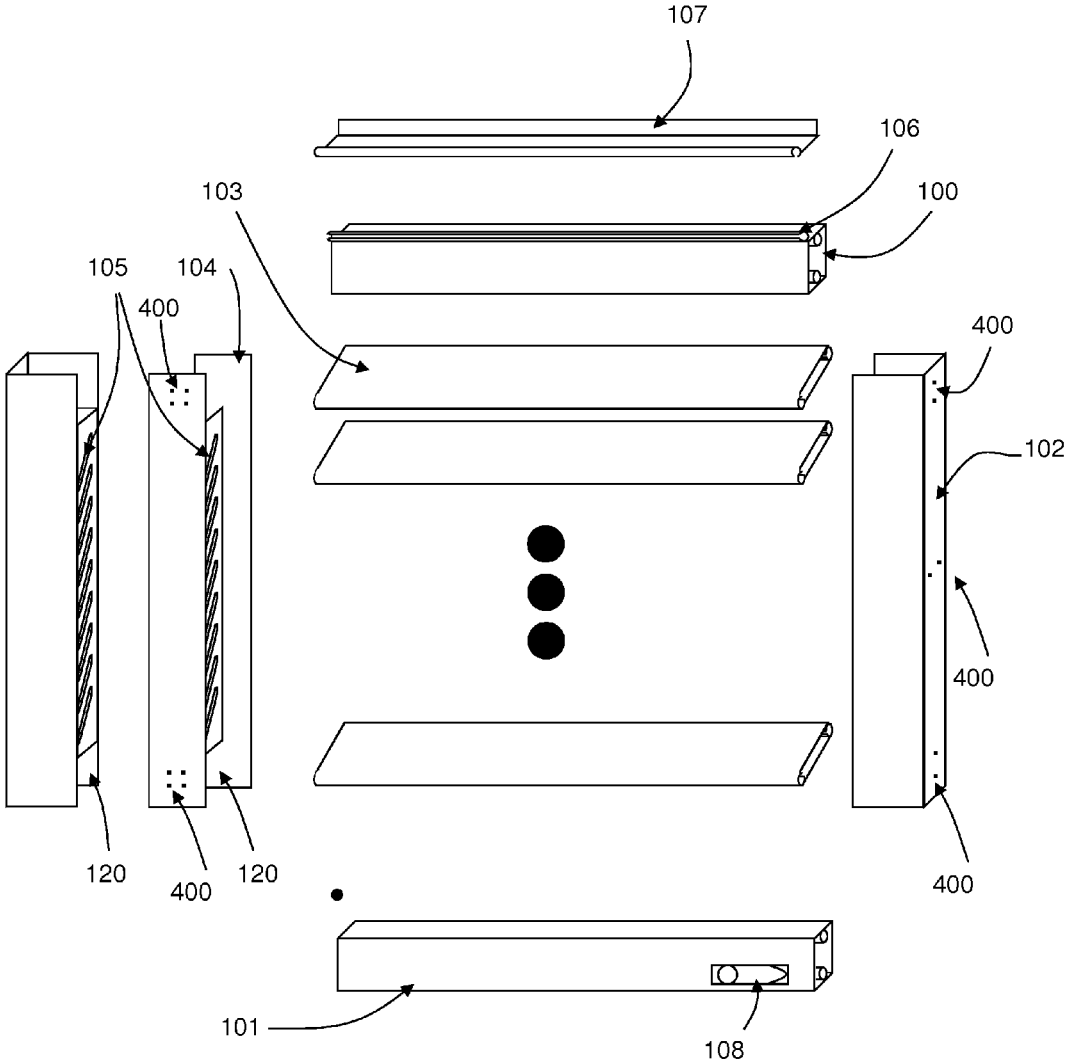
FIG. 1 is an exploded view of a shutter according to an embodiment of the invention.
Figure 2:
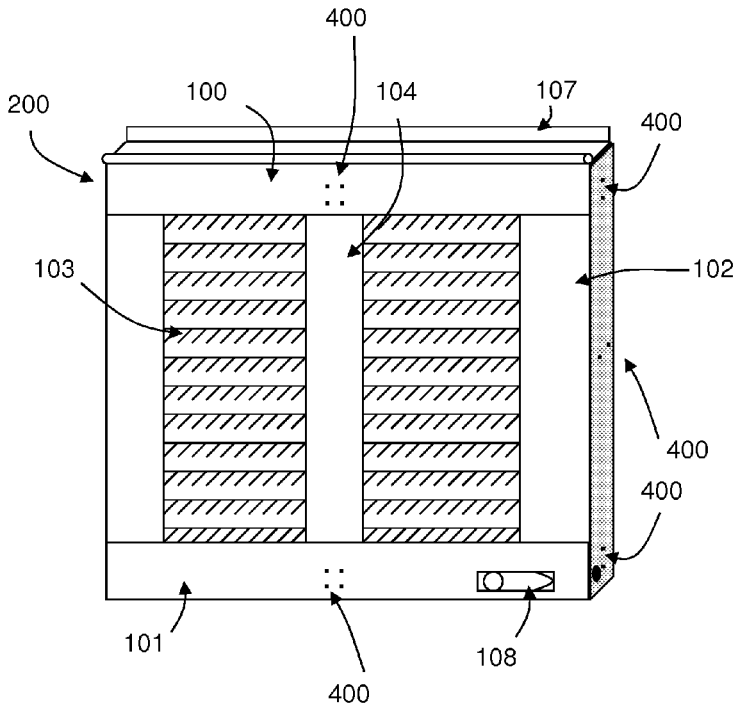
FIG. 2 is a front view of a shutter according to an embodiment of the invention.

Referring now to FIGS. 1 and 2, a preferred embodiment of the invention is shown. A metal top 100, a metal bottom 101, and metal sides 102 collectively form the outer shell of a shutter frame. A support column 104 is fixed between metal top 100 and metal bottom 101, and is preferably substantially centered between sides 102. Metal slats 103 are inserted into diagonal openings 105 in the sides 102 and support column 104. A connector 106 is affixed to metal top 100. A top support connector 107, which attaches to another structure (such as a building) mates with connector 106 to define a rotating joint, such as a hinge, that allows the completed shutter to rotate. A lock 108 can be provided to keep the shutter secured in a particular position. Screws or similar fasteners are preferably inserted as appropriate to form a solid structure.

Figure 5A:
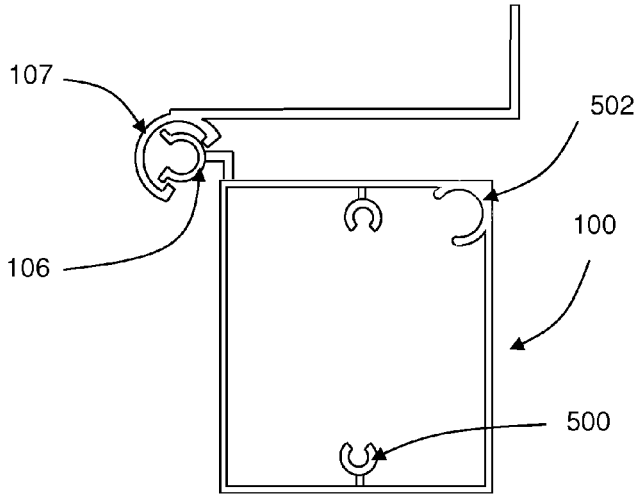
FIGS. 5*a* and 5*b* are side views of the metal top, metal bottom, and top support of a shutter according to an embodiment of the invention.
Figure 5B:
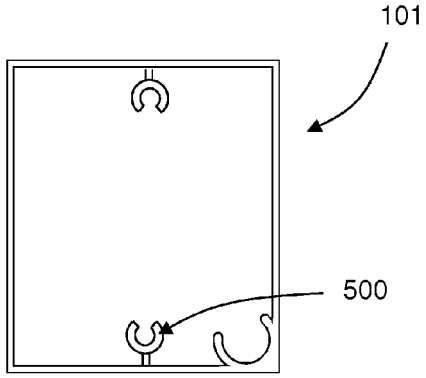
Figure 7:
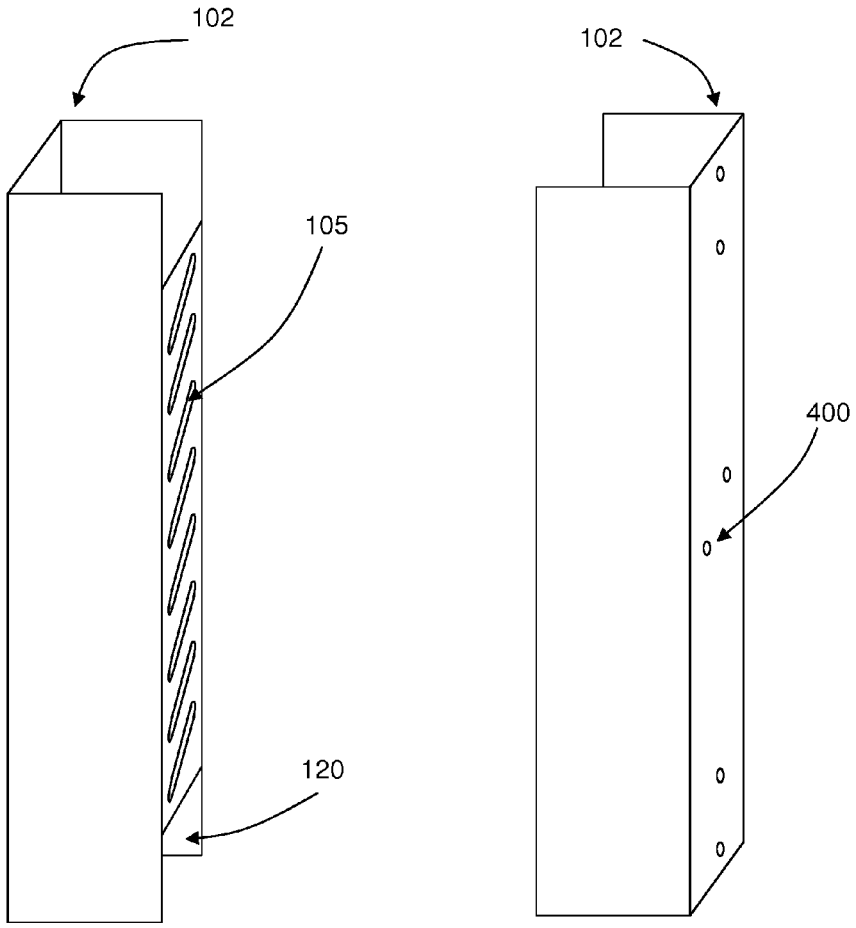
FIG. 7 is a perspective view of the sides of a shutter according to an embodiment of the invention.

Referring now also to FIGS. 5*a*, 5*b* and 7, metal top 100 and metal bottom 101 are preferably hollow rectangles, possibly with internal connectors (discussed below). The metal sides 102 are also preferably hollow rectangles that have recesses 120 in the top and bottom of the inwardly facing surface to receive metal top 100 and metal bottom 101.

Figure 4:
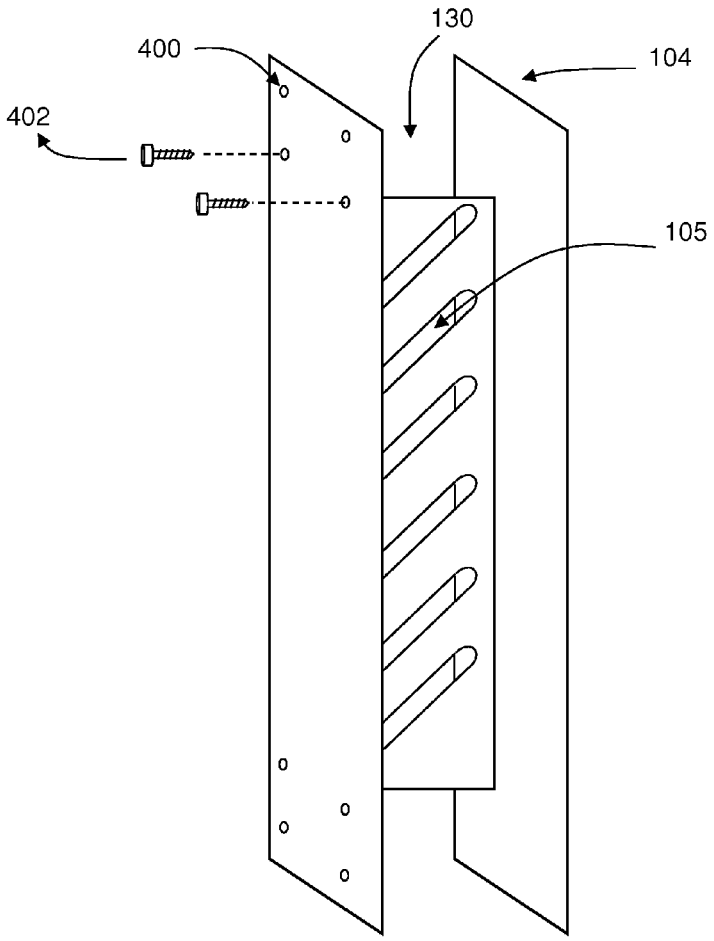
FIG. 4 is a perspective view of support beam of a shutter according to an embodiment of the invention.
Figure 6:
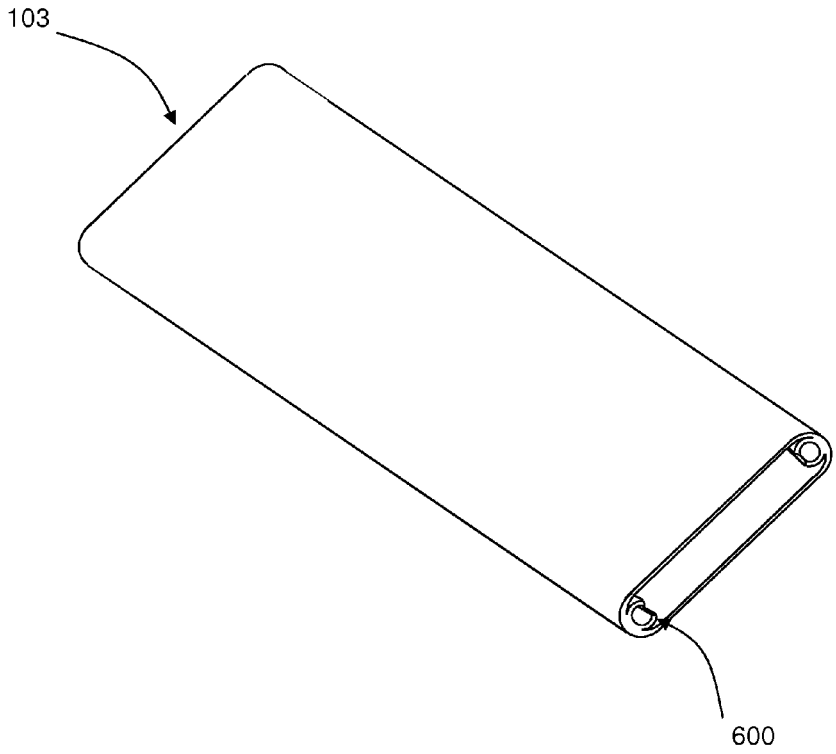
FIG. 6 is a perspective view of a slat of a shutter of a shutter according to an embodiment of the invention.

Referring now also to FIGS. 4 and 6, the support column 104 is preferably "I" shaped, with a flat surface on the front and back of the shutter and the neck of the "I" connecting the two surfaces. The neck center connector is cut away at the top and bottom to define recesses 130, allowing the metal top 100 and bottom 101 to fit between the front and back surfaces of the support column 104. Several openings 105 each receive a slat 103. Slats 103 and the corresponding openings 105 are preferably "capsule" shaped in their cross section, in that they have rounded ends separated by flat sides.

FIG. 2 illustrates how the individual pieces in FIG. 1 interconnect to form a shutter 200. The slats 103 are slid into slots 105 of support 104. Sides 102 then receive slats 103 through their openings 105, thereby capping the ends of slats 103. Metal top 100 and metal bottom 101 are inserted into the recesses 120 and 130 to define the frame. The components are connected together, preferably through screws 402 shown in various drawings to thereby form the completed shutter. Top support connector 107 is mounted onto a structure over the area to be protected, typically a window. Connector 106 mates with connector 107 to rotatably support the shutter over the frame.

Figure 3A:
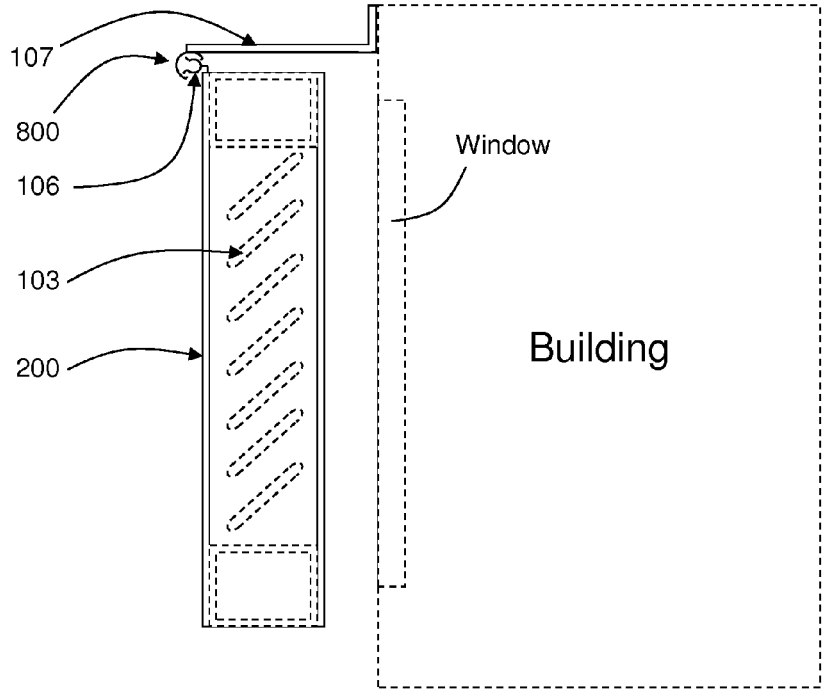
FIGS. 3*a* and 3*b* are side views of a shutter connected to a building in open and closed positions according to an embodiment of the invention.
Figure 3B:
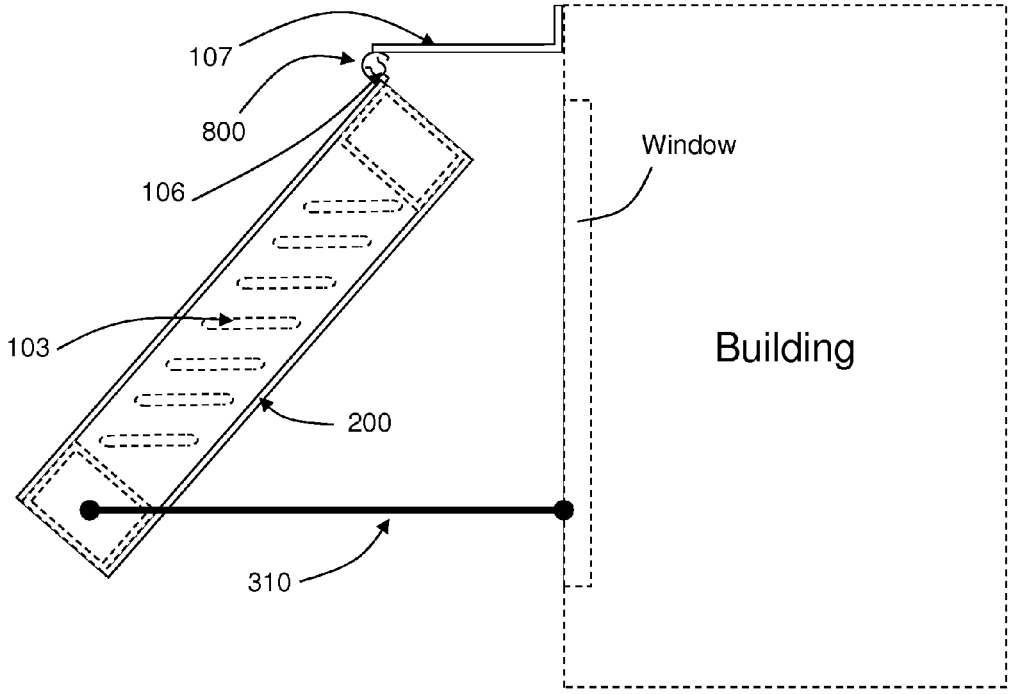

Referring now to FIGS. 3*a* and 3*b*, shutter 200 rotates between an open (FIG. 3*b*) and closed (FIG. 3*a*) position. The closed position is substantially vertical, such that slats 103 overlap to block any incoming debris along the horizontal plane. When in this position, the underlying structure is effectively protected from exterior forces, such as hurricane force winds and debris carried on such winds. In theory, debris could pass through the shutter if it entered on an upward angle substantially parallel to slats 103; however, such upward wind direction is not a characteristic of hurricanes, and the opening between slats 103 (preferably less than 1") is so small as to effectively prevent anything larger than a pebble from getting through. The design thus provides the necessary degree of hurricane protection which complies with most if not all current building code requirements in the coastal United States. Lock 108 keeps shutter 200 in this closed position. Lock 108 can be a bolt, a latch to hold a padlock, or any other type of lock.

The closed position also allows ambient light and air to continue to enter the structure. While the amount of light and air is less than there would be if there were no shutter at all, it is more than most standard metal shutter systems (which only allow light and air in through gaps in the perimeter). This design thus substantially reduces the claustrophobic effects that come with many prior art designs.

FIG. 3*b* shows shutter 200 in the open position, in which slats 103 are substantially horizontal. This allows air and light to enter along the horizontal path, as well as from below shutter 200. Shutter 200 thus does not need to be removed from the structure when not in use. Shutter 200 also acts as a sun shade, with obvious added cooling benefits. A pivotal arm or rod 310 can be used to hold shutter 200 in this open position. In one embodiment, a locking rod channel 502 may be formed in top 100 and/or bottom 101 for housing bolt 108 which can slide into a mounted latch (e.g., element G in FIG. 15) to secure the shutter in a closed position.

Figure 10:
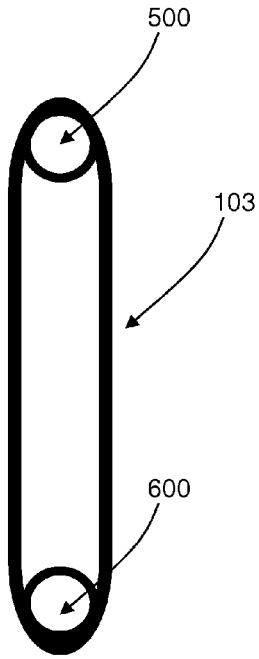
FIG. 10 is a a side view of a slate with full cylinders.

As shown in FIGS. 5*a*, 5*b* and 6, top 100, bottom 101 and slats 103 are preferably hollow with at least two partial or full cylinders 500 and 600 (full cylinders shown in FIG. 10). Cylinders 500 and 600 act as guides to receive assembly screws. Cylinders 500 and 600 may be smooth or threaded (either formed as such or with added threaded inserts). If smooth, the diameter of cylinders 500 and 600 is preferably smaller than the shaft of the screw 400 used to secure it; the presence of screw 400 will push the walls of cylinders 500 and 600 apart, thereby creating a pressure lock on the screw to hold it in place. Rivets could also be used.

FIG. 4 illustrates an "I" shaped support column 104. Recesses 130 allow the front and back surfaces of column 104 to slide over the top 100 and bottom 101 of the shutter frame. It is preferably affixed to the top 100 and bottom 101 with screws 402 via screw-holes 400.

FIG. 7 illustrates the metal sides according to one embodiment of the invention. The sides 102 are preferably long, hollow rectangles. At the top and bottom of the sides 102, the surface of the rectangle facing the center of the shutter 201 is cut away, allowing the top 100 and bottom 101 to fit between the front and rear surfaces of the sides 102. The top 100 and bottom 101 are affixed to the sides 102 with screws 402 via screw-holes 400 located on the surface of the sides 102 facing away from the center of the shutter.

Figure 8:
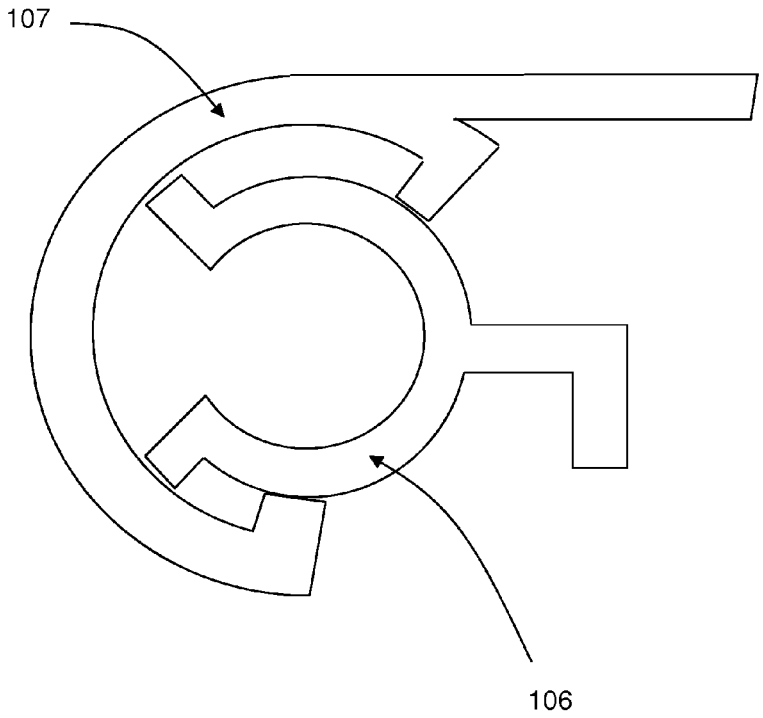
FIG. 8 is a side view of a hinge configuration of a shutter according to an embodiment of the invention.
Figure 9:
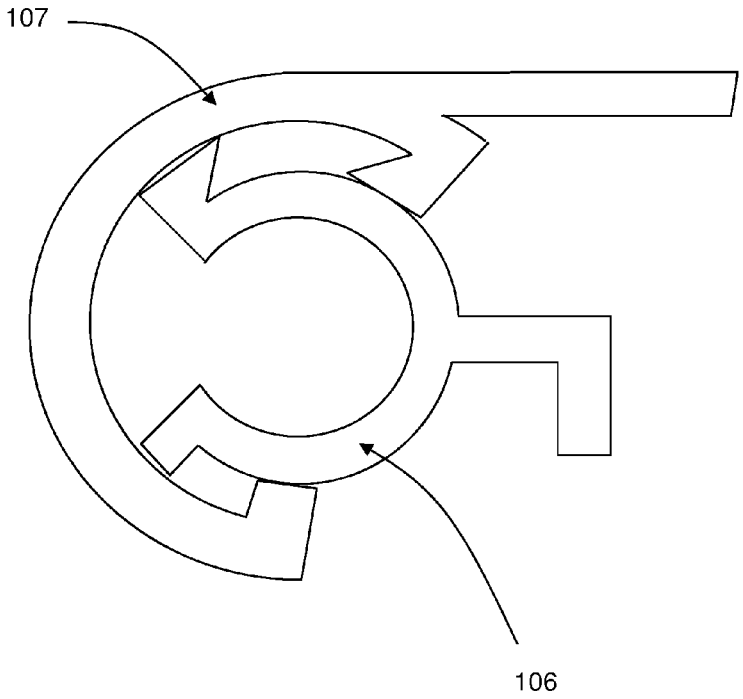
FIG. 9 is a side view of a hinge configuration of a shutter according to an embodiment of the invention.

Referring now to FIG. 8, connector 106 is preferably a partial cylinder with two small tabs extending outward from its ends. Connector 107 is also a partial cylinder, but it has tabs on the inside of the cylinder. The tabs extending from the portion of a hinge 106 and the tabs extending into the connector 107 define the angle of rotation of the shutter 200. Although the tabs are shown as uniform, they may have any desired shape. FIG. 9 shows a potential alternate configuration.

The two connectors 106 and 107 mate preferably by coaxially aligning the partial cylinders and then sliding one relative to the other. This forms a hinge and upper mount that supports shutter 200. As the shutter 200 opens, the connector tabs and the portion-of-the-hinge tabs eventually meet, which stops the shutter from rotating further.

The various metal components are preferably made from extruded aluminum in commercial grade lengths, typically 16 feet. The various openings 105 are punched into the commercial length units. The commercial length units are then cut to size as desired, either to pre-selected dimensions or custom designs. Recesses 130 and screw holes 402 are then made in the cut components, and the components are assembled as discussed above.

FIG. 10 shows across section of a slat 103 with full cylinders 500 and 600.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A shutter comprising:

a metal top, a metal bottom, and two metal sides, configured to be collectively assembled into a frame;

a plurality of metal slats, the slats being substantially hollow and defining a substantially hollow area therein;

at least one of the slats having at least one partial cylinder extending therein, said at least one partial cylinder being (a) open along its length to the hollow area, (b) configured to receive at least one of a screw and rivet on either side of a corresponding slat, and (c) having edges along its length terminating within the hollow area;

at least one metal support column having openings configured to receive said slats between said sides and also configured to be affixed to the top and bottom;

a lock;

at least one portion of a hinge configured to be affixed to said metal top;

and at least one connector configured to be affixed to said at least one portion of a hinge and to another structure;

wherein said top, said bottom, said sides, said slats, said at least one support column, said at least one hinge, and said at least one connector can be assembled to define said shutter, said shutter being rotatable between a first position which is substantially vertical, and a second position which is non-vertical; and wherein said lock is configured to hold the shutter in the first position.

2. The shutter according to claim 1, wherein the slats are diagonal relative to a horizontal plane when the frame is in said first position.

3. The shutter according to claim 1, wherein the slats are substantially horizontal when the frame is in said second position.

4. The shutter according to claim 1 wherein the sides have a plurality of parallel, diagonal slots configured to receive said slats.

5. The shutter according to claim 1, wherein the hinge comprises a first partially cylindrical portion and a second partially cylindrical portion, said second partially cylindrical portion configured to be coaxially inserted into said first partially cylindrical portion.

6. The shutter according to claim 1, wherein the lock is a bolt, a deadbolt, a padlock, a catch, a lever, or a latch.

7. The shutter according to claim 1, wherein the support column is "I"shaped.

8. The shutter according to claim 1, wherein the at least one of a screw and a rivet are inserted through at least one of the metal sides into at least one of the at least one partial cylinder to thereby secure the corresponding at least one slat to the at least one of the metal sides.

9. The shutter according to claim 1, wherein said top and bottom comprise at least one hollow partial cylinder.

10. The shutter according to claim 9, wherein screws are inserted into said at least one hollow partial cylinder of the top and bottom through said sides.

11. The shutter according to claim 1, wherein the edges substantially face each other unobstructed.

12. A shutter comprising:

a metal top, a metal bottom, and two metal sides, configured to be collectively assembled into a frame;

a plurality of metal slats, the slats being substantially hollow area therein;

at least one of the slats having at least one partial cylinder extending therein, said at least one partial cylinder being (a) open along its length to the hollow area, (b) configured to receive a screw or rivet on either side of a corresponding slat, and (c) having edges along its length terminating within the hollow area;

at least one metal support column having openings configured to receive said slats between said sides and also configured to be affixed to the top and bottom;

at least one of a screw and, a rivet inserted through at least one of the metal sides into at least one of the at least one partial cylinder to thereby secure the corresponding at least one of the slates to the at least one of the metal sides;

a lock;

at least one portion of a hinge configured to be affixed to said metal top;

and at least one connector configured to be affixed to said at least one portion of a hinge and to another structure;

wherein said top, said bottom, said sides, said slats, said at least one support column, said at least one hinge, and said at least one connector can be assembled to define said shutter, said shutter being rotatable between a first position which is substantially vertical, and a second position which is non-vertical; and wherein said lock is configured to hold the shutter in the first position.

13. A shutter comprising:

a metal top, a metal bottom, and two metal sides, configured to be collectively assembled into a frame;

a plurality of metal slats, the slats being substantially hollow and defining a substantially hollow area therein;

at least some of the slats having a full cylinder extending therein, said full cylinder being configured to receive a screw or rivet on either side of a corresponding slat;

at least one metal support column having openings configured to receive said slats between said sides and also configured to be affixed to the top and bottom;

a lock;

at least one portion of a hinge configured to be affixed to said metal top;

and at least one connector configured to be affixed to said at least one portion of a hinge and to another structure;

wherein said top, said bottom, said sides, said slats, said at least one support column, said at least one hinge, and said at least one connector can be assembled to define said shutter, said shutter being rotatable between a first position which is substantially vertical, and a second position which is non-vertical; and wherein said lock is configured to hold the shutter in the first position.

14. The shutter according to claim 13, wherein at least one of a screw and a rivet are inserted through at least one of the metal sides into at least some of full cylinders to thereby secure the corresponding at least one slat to the at least one of the metal sides.

* * * * *